US005083349A

United States Patent [19]

Axtell

[11] Patent Number: 5,083,349

[45] Date of Patent: Jan. 28, 1992

[54] SLIDE FASTENER SLIDER

[75] Inventor: Rodney J. Axtell, Gastonia, N.C.

[73] Assignee: Talon, Inc., Meadville, Pa.

[21] Appl. No.: 666,651

[22] Filed: Mar. 8, 1991

[51] Int. Cl.[5] ..... A44B 19/26

[52] U.S. Cl. ..... 24/429; 24/415; 24/430

[58] Field of Search ..... 24/429, 419, 430, 431, 24/414, 415, 426; 294/3.6

[56] References Cited

U.S. PATENT DOCUMENTS

| | | | |
|---|---|---|---|
| 1,302,606 | 5/1919 | Sundback | 24/429 |
| 1,681,550 | 8/1928 | Marinsky | 24/429 |
| 1,773,150 | 8/1930 | Legat | 24/430 |
| 2,160,819 | 6/1939 | Behrens | 24/429 |
| 2,841,851 | 7/1958 | Van Amburg et al. | 24/415 |
| 3,153,269 | 10/1964 | Berry | 24/429 |
| 4,348,789 | 9/1982 | Brown | 24/414 |
| 4,823,447 | 4/1989 | Akashi | 24/419 |

FOREIGN PATENT DOCUMENTS

| | | | |
|---|---|---|---|
| 0028199 | 2/1931 | Australia | 24/414 |
| 0187503 | 10/1956 | Fed. Rep. of Germany | 24/415 |
| 56-11610 | 1/1981 | Japan | 24/429 |

*Primary Examiner*—Victor N. Sakran
*Attorney, Agent, or Firm*—Anthony A. O'Brien

[57] ABSTRACT

A slide fastener slider is disclosed as including spaced parallel wing members and a longitudinal axis therebetween, a pull-lug affixed to its top surface, a pull member operatively connected to said pull-lug for moving the slider relative to interlocking elements, with the pull member being movable parallel to the longitudinal axis, and ends on the pull-lug to exert a pulling force on the slider from below the top surface thereof.

4 Claims, 1 Drawing Sheet

FIG. 1
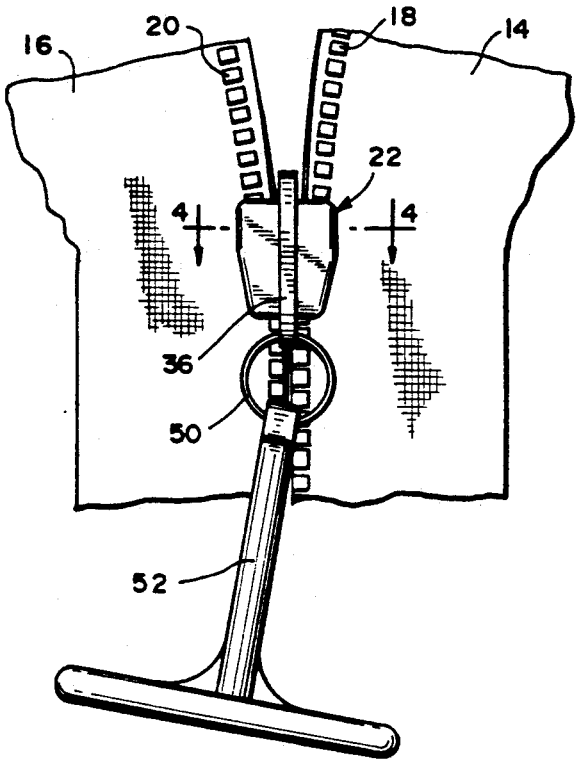
FIG. 2
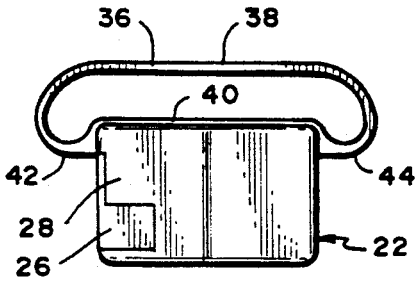
FIG. 3
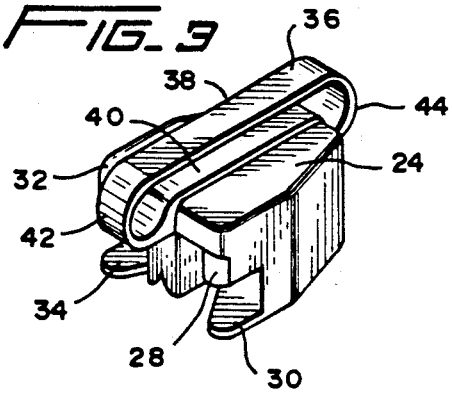
FIG. 4
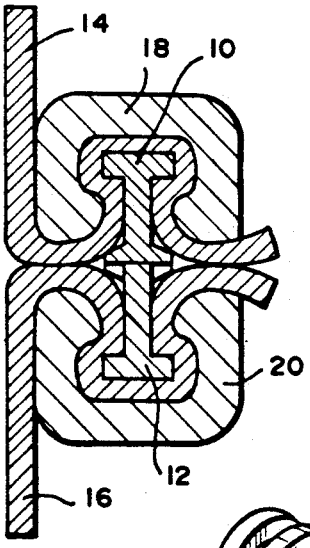
FIG. 5
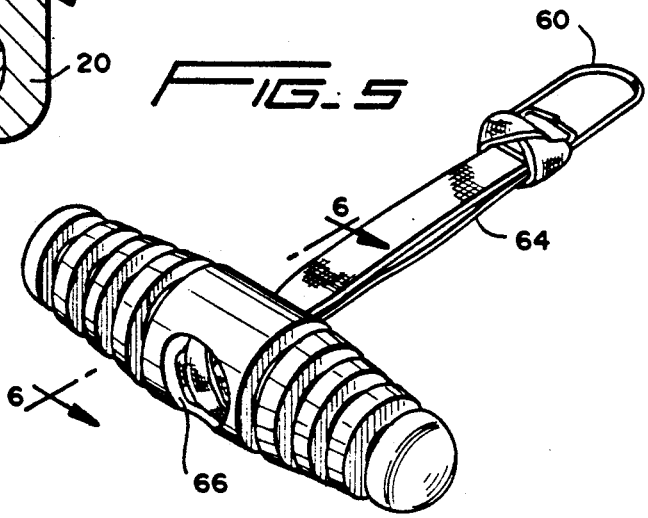
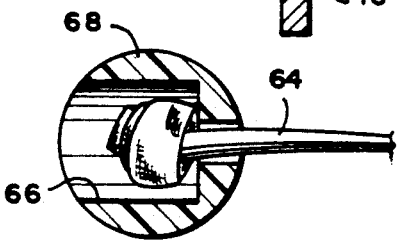
FIG. 6

SLIDE FASTENER SLIDER

TECHNICAL FIELD

The present invention relates to slide fasteners and, more particularly to the slider mechanism for opening and closing the slide fastener.

DESCRIPTION OF THE PRIOR ART

The prior art shows pressure-proof slide fasteners using Neoprene or plastic coated tapes that when compressed together by interlocking elements, creates a seal that excludes vapors, liquids, dust, light and air. Such a slide fastener is illustrated in U.S. Pat. No. 4,348,789 which is incorporated herein by reference.

As is shown in U.S. Pat. No. 4,348,789, pressure-proof slide fasteners function on the principle of an interference fit between the double chain width of a closed fastener and the mouth width of its slider. It is this interference that compresses the rubberized tapes and assures a seal. This mechanical necessity is always accompanied by a high operating force of the slider on the chain and as a result, the force of the wire stirrup pull on the slider lug causes the slider to tilt in the direction of its pull, consequently requiring even more effort to compress and close the fabric. Such operation also promotes fraying of the coated tapes fabric insert, which is exposed at the tape edge. The tilting action of the slider also tends to create misalignment with the incoming stringer halves at the merging end of the slider, which leads to element mismesh and bent or broken element parts.

Cast sliders utilized on pressure-proof slide fasteners are generally of two types: first, a centrally located pull lug which allows a stirrup pull to actuate from a point inside each longitudinal extremity of the slider as shown in U.S. Pat. No. 4,348,789; and, second, slider having lugs located on its side walls, each being longitudinally central and on the center line of the interlocking elements, which allows a saddle stirrup pull to operate from midpoint of the slider and in so doing tends to reduce the slider's tilting motion.

SUMMARY OF THE INVENTION

The present invention is summarized in that a slide fastener slider includes a pair of spaced wing members having surfaces spaced from each other to define a y-shaped channel, a spacer disposed between front portions of the wing surfaces and adapted to permit relative movement between the slider and fastener stringers in the y-shaped channel, a top surface on upper portions of the wing members, a pull-lug centrally on the top surface and longitudinally between the spaced wing members, front and rear attachments on the lug below the top surface, a pull member with an operating element in the pull-lug for movement between the attachments and thereby actuate the slider beyond the longitudinal extremities of the slider and above the centerline of fastener stringers in the y-shaped channel.

OBJECTS OF THE INVENTION

It is an object of the present invention to lessen the slider operating force in a slide fastener.

Another object of the invention is to reduce the risk of element mismesh of the interlocking elements in a slide fastener.

The invention has a further object in that the slider of a slide fastener is provided with easier docking and undocking onto the sealing pad of a pressure-proof slide fastener.

Other objects, features and advantages will become apparent from the following description taken in conjunction with the accompanying drawing.

BRIEF DESCRIPTION OF THE DRAWING

FIG. 1 is a plan view of a broken-away portion of a slide fastener embodying the present invention.

FIG. 2 is a side elevational view of an enlarged scale of the slider shown in FIG. 1.

FIG. 3 is a perspective view of the slider shown in FIG. 2.

FIG. 4 is a cross-sectional view on an enlarged scale taken along the line 4—4 of FIG. 1.

FIG. 5 is a perspective view of a second type of pull construction.

FIG. 6 is a cross-sectional view of a pull detail taken on the line 6—6 of FIG. 5.

DETAILED DESCRIPTION

As is illustrated in FIG. 1, the present invention is embodied in a slide fastener, which includes a pair of rows interlocking coupling elements 10 and 12 secured to facing edges of flexible tapes 14 and 16, respectively, by any suitable means such as clamps 18 and 20, respectively. These coupling elements, tapes and clamps are found in the prior art, as set forth in U.S. Pat. No. 4,348,789; thus, members 10, 14 and 18 form a left hand stringer while members 12, 16 and 20 form a right hand stringer.

A slider, indicated generally at 22 is a metallic casting having a flat top surface 24 covering a front nose piece 26 separating a pair of spaced left upper and lower wings 28 and 30 from a pair of spaced right upper and lower wings 32 and 34 for the passage of the slider 22; see FIGS. 2 and 3. A pull-lug 36 is a closed loop and includes a pair of spaced upper and lower flat plates 38 and 40 being joined by an arcuate front end 42 and arcuate rear end 44. As shown in FIGS. 2 and 3, the arcuate ends are slightly larger than a semi-circle and define front and rear attachments for the pull-lug 36.

The arcuate ends 42 and 44 define terminals that are disposed below the flat plate 40 and the top surface 24. The pull-lug 36 may be integrally cast with the body of slider 22 or it may be affixed as a separate unit as by welding, etc. The exterior portions of the end terminals 42 and 44 are shaped to nest against the adjacent surfaces of the top surface 24 and the adjacent right angle surfaces.

An operating member in the form of a circular ring 50 is disposed in the loop of the pull-lug for movement between the front and rear attachments. The ring 50 is also mounted on a handle 52 and the loop of the pull-lug 36; the ring 50 and the handle 52 are joined together in an articulated manner to control the pulling force on the slider 22.

FIGS. 5 and 6 illustrate a different arrangement for the pulling force applied to the slider 22 in that the operating member is a generally rectangular ring 60 having one part disposed in the loop of the pull-lug 36 and another part attached to one end of a flexible handle 62 in the form of a flexible strap or fabric 64. An opposite end of the fabric 64 has a knotted connection with the bore 66 of cross bar 68. The use of the flexible fabric 64 in the operating member provides for longitudinal adjustment as well as for ease of movement.

With the pull-lug 36 being disposed centrally on the top surface 24, it thus moves along its longitudinal axis and when the pull member is disposed in one of the end terminals 42 or 44, the pulling force on the slider reduces tilting to a minimum by the introduction of a centrally located wraparound pull-lug 36 that allows a wire stirrup (50 or 60) to locate and actuate beyond the longitudinal extremeties of the slider 22 and immediately above the centerline of the interlocking coupling elements 10 and 12. The pull-lug configuration dramatically reduces slider tilting and allows inline movement of the slider during its opening and closing operations Inasmuch as the present invention is subject to many modifications and changes in details, it is intended that all matter contained in the foregoing specification or shown on the accompanying drawing shall be interpreted as illustrative and not in a limiting sense.

I claim:

1. A slider for a slide fastener having interlocking stringers a first pair of spaced wing members (28–30) and a second pair of spaced wing members (32–34) defining a channel therebetween, a nose spacer (26) disposed between front portions of said wing members to permit engagement and disengagement of opposed stringers in said channel, a top surface (24) extending across upper portions of said wing members (28 and 32), a pull lug (36) defining a closed loop and having spaced upper and lower flat plates (38 and 40) and having arcuate front and rear ends (42 and 44), each arcuate end being larger than a semi-circle defining attachment terminals disposed partially below said top surface (24), said lower flat plate (40) being integrally secured to said top surface (24) with said arcuate ends (42 and 44) being integrally secured to respective front and rear surfaces extending from said top surface (24), an operating member (50) disposed in said loop and being movable along the lower plate (40) between the arcuate ends (42 and 44) for selective slider movement, and said operating member exerting a pulling force to a selective arcuate end frombelow the top surface (24) and thereby reducing tilting and permitting inline operation of the slider during opening and closing movements thereof.

2. A slider for a slide fastener as claimed in claim 1 wherein said operating element is a ring-like device.

3. A slider for a slide fastener as claimed in claim 1 wherein said operating element is a rectangular-like device.

4. A slider for a slide fastener as claimed in claim 1 wherein an articulated connection connects said pull member and said pull-lug.

* * * * *